US007668474B2

(12) United States Patent
Muranaka

(10) Patent No.: US 7,668,474 B2
(45) Date of Patent: Feb. 23, 2010

(54) IMAGE FORMING APPARATUS

(75) Inventor: Nobuyuki Muranaka, Tokyo (JP)

(73) Assignee: Oki Data Corporation, Tokyo (JP)

( * ) Notice: Subject to any disclaimer, the term of this patent is extended or adjusted under 35 U.S.C. 154(b) by 69 days.

(21) Appl. No.: 12/010,939

(22) Filed: Jan. 31, 2008

(65) Prior Publication Data

US 2008/0199202 A1 Aug. 21, 2008

(30) Foreign Application Priority Data

Feb. 15, 2007 (JP) ..... 2007-035089

(51) Int. Cl.
*G03G 15/00* (2006.01)

(52) U.S. Cl. ..... 399/72; 399/75; 399/301

(58) Field of Classification Search ..... 399/15, 399/49, 72, 74, 75, 301
See application file for complete search history.

(56) References Cited

U.S. PATENT DOCUMENTS 4,970,557 A * 11/1990 Masuda et al. ..... 399/43
5,461,462 A * 10/1995 Nakane et al. ..... 399/15
5,708,915 A * 1/1998 Noguchi et al. ..... 399/49

FOREIGN PATENT DOCUMENTS

| | | |
|---|---|---|
| JP | 7-20669 | 1/1995 |
| JP | 8-123261 | 5/1996 |
| JP | 2000-338838 | 12/2000 |
| JP | 2004-126519 | 4/2004 |
| JP | 2006-301367 | 11/2006 |

* cited by examiner

*Primary Examiner*—David P Porta
*Assistant Examiner*—Benjamin Schmitt
(74) *Attorney, Agent, or Firm*—Rabin & Berdo, PC

(57) ABSTRACT

An image forming apparatus is supplied which is able to eliminate redundant item in checking and adjusting print quality before executing print process and only perform item check being really necessary so as to reduce waiting time of user. In the image forming apparatus, a non-operation time calculating section 14 sets an end of last print process as a start point and calculates a non-operation time; a print controlling section 15 controls an adjustment of print quality on the basis of an acquirement of the print quality corresponding to quality item previously set and an acquirement result of the print quality, according to a length of the non-operation time.

10 Claims, 14 Drawing Sheets

| No. | TEST EXECUTION CONDITION | TEST PATTERN |
|---|---|---|
| 1 | NON-OPERATION FOR ONE MONTH OR OVER | TONER DEGRADATION DETECTION |
| 2 | NON-OPERATION FOR ONE WEEK OR OVER | OLIGOMER ADHESION DETECTION |
| 3 | NON-OPERATION FOR ONE DAY OR OVER | COLOR DEVIATION ADJUSTMENT |
| 4 | NON-OPERATION FOR THREE HOURS OR OVER | DENSITY CORRECTION |

*FIG. 3*

IN THE CASE THAT THE COLOR PATTERN LEFTWARD DEVIATES TWO DOTS WITH RESPECT TO THE BLACK PATTERN

| No. | TEST EXECUTION CONDITION | TEST EXECUTION CONDITION (WHEN POWER IS TURNED ON) | TEST PATTERN |
|---|---|---|---|
| 1 | NON-OPERATION FOR ONE MONTH OR OVER | NON-OPERATION FOR TWENTY DAYS OR OVER | TONER DEGRADATION DETECTION |
| 2 | NON-OPERATION FOR ONE WEEK OR OVER | NON-OPERATION FOR FIVE DAYS OR OVER | OLIGOMER ADHESION DETECTION |
| 3 | NON-OPERATION FOR ONE DAY OR OVER | NON-OPERATION FOR TWELVE HOURS OR OVER | COLOR DEVIATION ADJUSTMENT |
| 4 | NON-OPERATION FOR THREE HOURS OR OVER | NON-OPERATION FOR A TIME LESS THAN TWELVE HOURS | DENSITY CORRECTION |

*FIG. 14*

IMAGE FORMING APPARATUS

BACKGROUND OF THE INVENTION

1. Field of the Invention

The invention relates to an image forming apparatus to record an image onto a record medium.

2. Related Background Art

In image forming apparatus such as an electrophotographic printer, in the case to restart a print after the print has not be executed for a long time, an image quality degradation may happen. A main reason for this is that, as a photosensitive drum serving as the image carrying body, the transferring roller and the transferring belt of the electrophotographic printer are contacting in an identical position. In order to solve the problem of the image quality degradation, before starting the print, various processes such as density correction, color deviation correction, oligomer elimination and the like are executed (refer to Patent document 1).

Patent document 1: Japan patent publication 2000-338838.

However, in conventional image forming apparatus, no matter the time without executing the print is long or short, all of the processes will be executed before starting the print. Thus, there is a problem to be solved, that is, because unnecessary processes also are executed, the processing time becomes long, so that an user must wait for a longer time.

SUMMARY OF THE INVENTION

It is, therefore, an object of the invention to provide an image forming apparatus capable of solving the above problem.

According to the present invention, there is provided an image forming apparatus comprising a non-operation time calculating section that regards an end of a last print process as a start point and calculates a non-operation time; and a print controlling section that controls an adjustment of a print quality on the basis of an acquirement of the print quality corresponding to a predetermined quality item and an acquirement result of the print quality, according to a length of the non-operation time.

Moreover, the image forming apparatus may further comprise a storing section that stores a quality item designation table, which previously sets the quality item corresponding to the length of the non-operation time, and sets a test pattern corresponding to the quality item, wherein the print controlling section designates the quality item on the basis of the non-operation time calculated by the non-operation time calculating section, and uses the test pattern corresponding to the quality item to control the adjustment of the print quality on the basis of the acquirement of the print quality and the acquirement result of the print quality.

Moreover, in the image forming apparatus, the quality item may be composed of at least one of color deviation quantity, print density, oligomer adhesion and toner degradation.

Moreover, in the image forming apparatus, the non-operation time may be the time from an end of a first print process to a start of a second print process.

Moreover, in the image forming apparatus, the non-operation time may be the time from that a power source is finally turned off to when the power source is turned on again.

Moreover, in the image forming apparatus, a plurality of processes relative to the print process may be selectively performed to correspond to the length of the non-operation time. On one hand, the longer the non-operation time is, the larger the number of processes selected from the plurality of processes may be; on the other hand, the shorter the non-operation time is, the smaller the number of processes selected from the plurality of processes may be.

EFFECT OF THE PRESENT INVENTION

According to the present invention, because a non-operation time calculating section calculates a non-operation time by serving an end of the last print as a start point, and only an adjustment of necessary print quality is performed according to the calculated, it is possible to reduce the wait time of an user.

The above and other objects and features of the present invention will become apparent from the following detailed description and the appended claims with reference to the accompanying drawings.

BRIEF DESCRIPTION OF THE DRAWINGS

FIG. 3 is an explanation diagram of a test pattern table in embodiment 1;

FIG. 14 is an explanation diagram of a test pattern table in embodiment 2;

DETAILED DESCRIPTION OF THE PREFERRED EMBODIMENTS

Embodiments of the invention will be described in detail hereinbelow with reference to the drawings.

Embodiment 1

Firstly, as an example of an image forming apparatus in which the present invention is applied, a printer of electronic photograph is explained.

Explanation of Structure

Figure 1:
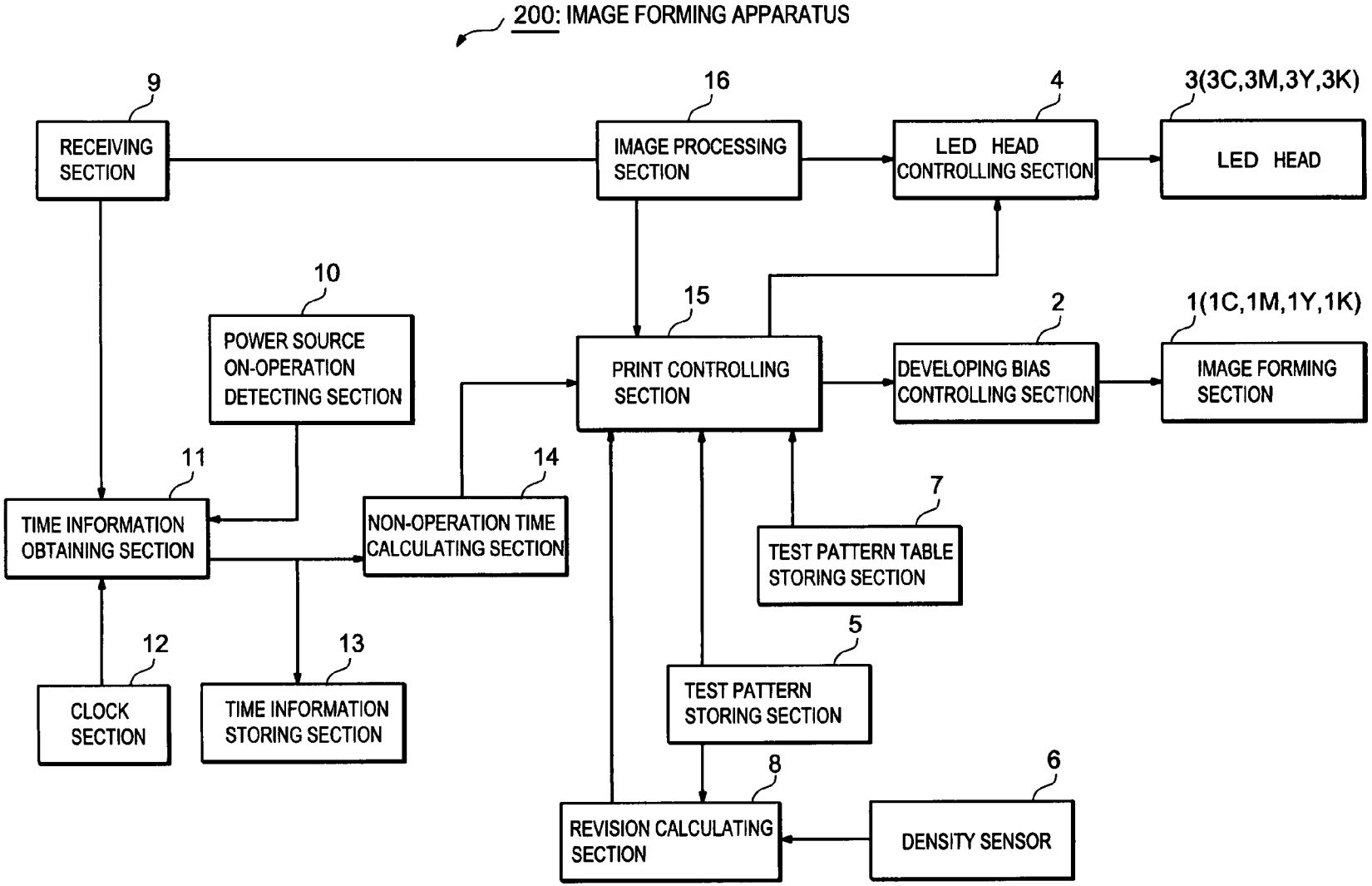
FIG. 1 is a block diagram showing a controlling system of a printing apparatus in embodiment 1.

FIG. 1 is a block diagram showing a controlling system of a printing apparatus in embodiment 1.

As shown in FIG. 1, a controlling system of a printing apparatus 200 serving as an image forming apparatus of the present invention comprises an image forming section 1 (1C, 1M, 1Y, 1K), a developing bias controlling section 2, a LED head 3 (3C, 3M, 3Y, 3K), a LED head controlling section 4, a test pattern storing section 5, a density sensor 6, a test pattern table storing section 7, a revision calculating section 8, a receiving section 9, a power source on-operation detecting section 10, a time information obtaining section 11, a clock section 12, a time information storing section 13, a non-operation time calculating section 14, a print controlling section 15 and an image processing section 16. Here, before a detail explanation regarding the respective components, a summary of the structure and operation of a printing machinery section of the printing apparatus 200 in which the controlling system is applied will be first explained.

Figure 2:
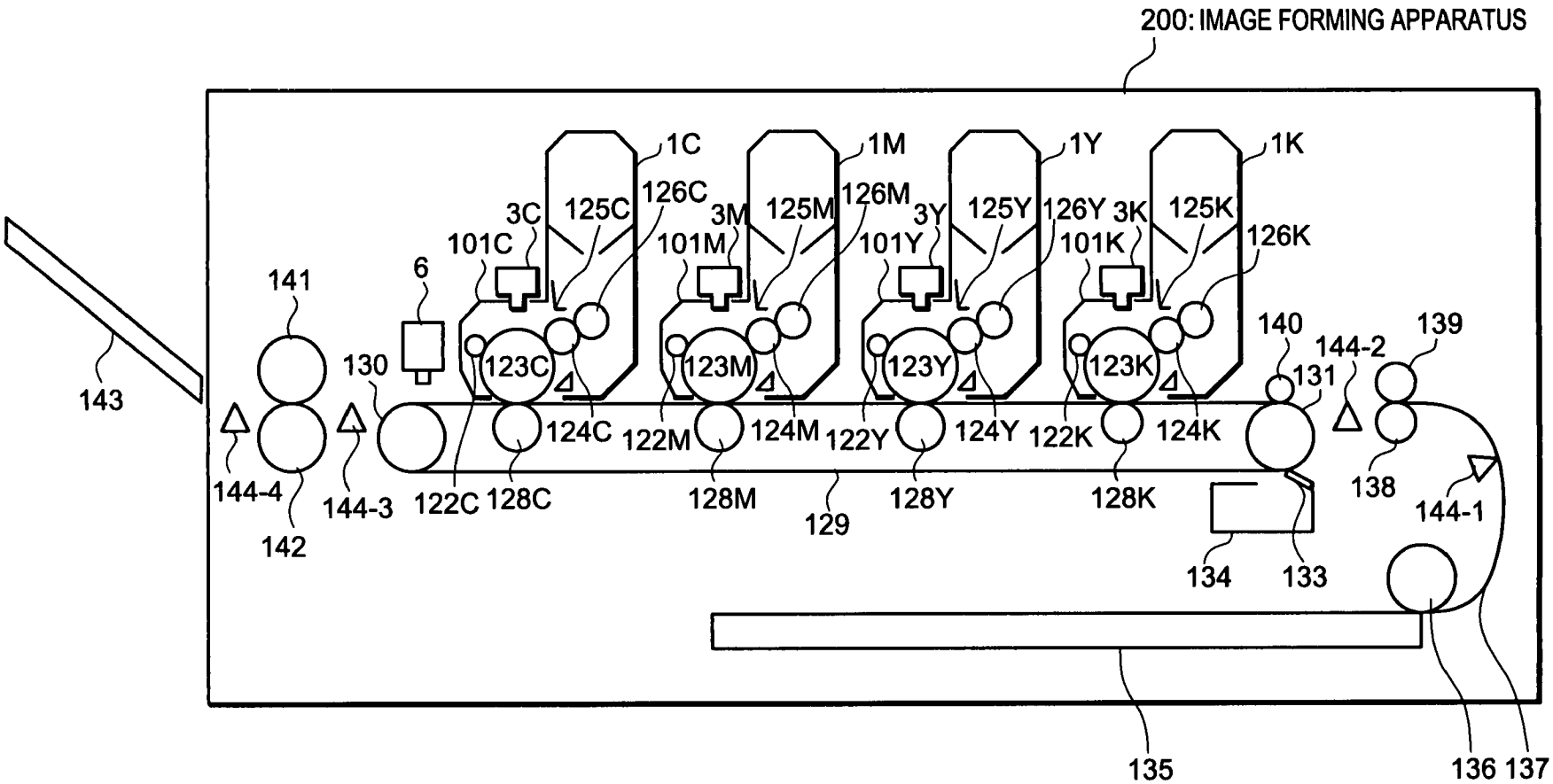
FIG. 2 is a summary cross section showing a printing machinery section.

FIG. 2 is a summary cross section showing a printing machinery section.

As shown by FIG. 2, in the printing machinery section, four image forming sections 1 (1K, 1Y, 1M and 1C) are arranged along a conveyance route toward an ejection side of a record medium from an insertion side of the record medium. Here, K, Y, M, C respectively represent colors of black, yellow, magenta, cyan (hereinafter, they are the same representation). Each image forming section 1 includes a charging roller 122 (122K, 122Y, 122M, or, 122C), a photosensitive drum 123 (123K, 123Y, 123M or 123C) whose surface is uniformly charged. Then, through the LED head 3 (3K, 3Y, 3M or 3C), an electrostatic latent image is formed on the surface of the photosensitive drum 123 according to image data.

The electrostatic latent image is developed through a developing roller 124 (124K, 124Y, 124M or 124C), a developing blade 125 (125K, 125Y, 125M or 125C), a sponge roller 126 (126K, 126Y, 126M or 126C) and the like to supply toner of a predetermined color from a toner cartridge 127 (127K, 127Y, 127M or 127C).

The toner having developed the electrostatic latent image is transferred onto the record medium conveyed on a conveying belt 129 along a direction from the image forming section 1K to the image forming section 1C, through a transferring roller 128 (128K, 128Y, 128M or 128C). The conveying belt 129 is rotated by a driving roller 130 and a driven roller 131.

Around the conveying belt 129, a density sensor 6 used for detecting the color density of a test pattern, a cleaning blade 133 and a waste toner tank 134 are furnished. The density sensor 6 is a sensor to emit predetermined light onto a below-mentioned test pattern formed on the conveying belt 129 and to receive its reflection light so as to detect the density value of the test pattern. The cleaning blade 133 is a part to remove the mentioned below test pattern formed on the conveying belt 129, and the waste toner tank 134 is a part to accommodate the removed waste toner.

When starting print, the record medium is taken out by a hopping roller 136 from a paper storage cassette 135, and is guided by a guider 137, then arrives at a registration roller 138. Skew or the like of the record medium is corrected by the registration roller 138 and an opposite pinch roller 139. Further, the record medium is conducted by the registration roller 138 into between an adsorbing roller 140 and the conveying belt 129. The adsorbing roller 140 is also charged through pressing the record medium together with the driven roller 131 and adsorbs the static electricity on the conveying belt 129.

Further, a toner image transferred by the transferring roller 128 (128K, 128Y, 128M or 128C) onto the record medium is conveyed into between a heat roller 141 and a pressure roller 142. Then the toner image is heated and is fixed on the record medium. After the toner image is fixed, the record medium is stacked to a stacker 143 and the printing process is ended.

In the process stated above, in order to detect positions of the record medium, respective position sensors 144 (144-1, 144-2, 144-3, 144-4) are furnished in predetermined places. That is all regarding the explanation of the summary of the printing machinery section of the printing apparatus 200 in which the controlling system is applied. Next is to return to the FIG. 1 and to continuously explain the respective components in detail.

The image forming sections 1 (1K, 1Y, 1M and 1C) are to receive image data and form images of respective colors onto the record medium in a tandem state. That is, each image forming section 1 is a part to form an output image according to a tone degree of image data to correspond to one color (K, Y, M or C).

The developing bias controlling section 2 is a part to change the bias voltage of the developing roller 124 (124K, 124Y, 124M and 124C) (FIG. 2) and to adjust the density of the output image on the basis of the control of the print controlling section 15.

The LED head 3 (3K, 3Y, 3M or 3C) is a part to expose the surface of the uniformly charged photosensitive drum 123 (123K, 123Y, 123M or 123C) (FIG. 2) and to form an electrostatic latent image on the basis of image data.

The LED head controlling section 4 is a part to increase or decrease the exposure voltage added on the LED head 3 (3K, 3Y, 3M or 3C) so as to vary the light emission quantity, to correct print position of the image data and to send print position signal to the LED head 3 on the basis of the control of the print controlling section 15.

The test pattern storing section 5 is a memory to previously store respective image data of a test pattern and reference data used for density correction, color deviation correction, oligomer adhesion detection and toner degradation detection.

The density sensor 6 (6C, 6L) is an optical sensor of a reflection type to measure a reflection intensity of the test pattern printed on the conveying belt 129 (FIG. 2) and to detect a density value with respect to the tone degree from the reflection intensity.

The test pattern table storing section 7 is a part to previously store respective execution contents for executing tests according to different non-operation times that the printing apparatus is left without executing print. Here, the contents (as an example) of a test pattern table will be explained.

FIG. 3 is an explanation diagram of a test pattern table in embodiment 1.

As shown in FIG. 3, a test pattern table stores a relation between a test execution condition of a test and a test pattern used for the test. As represented in the test pattern table, in the case that the non-operation time is one month or more, a toner degradation detection will be performed. Likewise, in the case that the non-operation time is one week or more, an oligomer adhesion detection will be performed; in the case that the non-operation time is one day or more, a color deviation adjustment will be performed; and in the case that the non-operation time is three hours or more, a density correction will be performed. Next is to return to the FIG. 1 to continue the explanation of the contents of the respective components.

The revision calculating section 8 is a part to perform the density correction, the color deviation adjustment, the oligomer adhesion detection and the toner degradation detection on the basis of the density value read from the density sensor 6 (6C, 6L) by using a predetermined pattern and the reference data stored in the test pattern storing section 5. The following is to explain the content of a test pattern and a content for correcting.

Figure 4A:
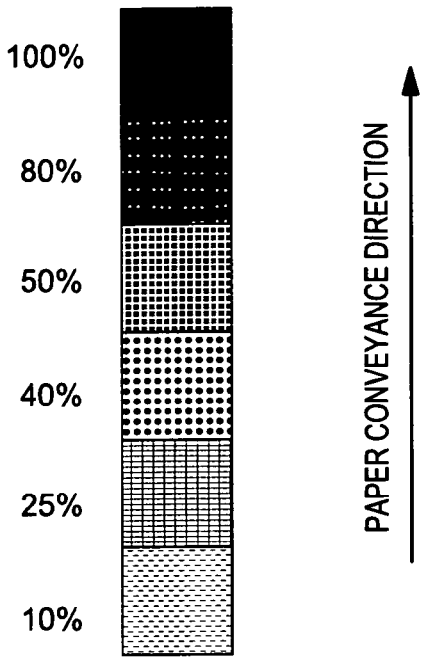
FIG. 4A is an explanation diagram of the test pattern for density correction use (I)
Figure 4B:
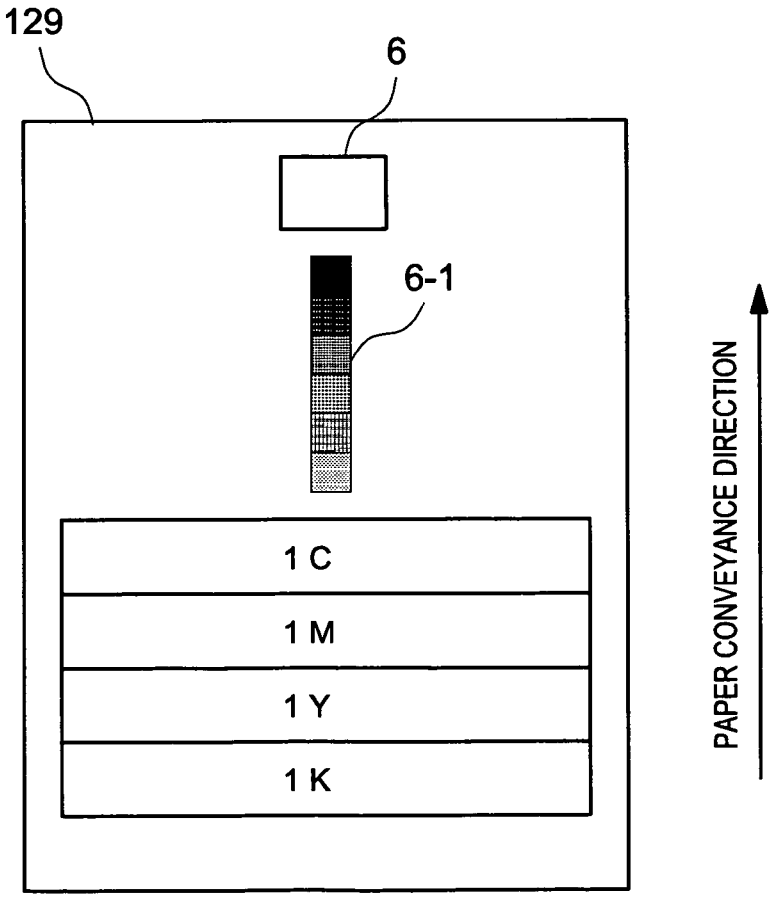
FIG. 4B is an explanation diagram of the test pattern for density correction use (II)

FIG. 4A is an explanation diagram of a test pattern for the density correction use (I); and FIG. 4B is an explanation diagram of a test pattern for the density correction use (II).

The FIG. 4A showed a pattern formation as an example, and the FIG. 4B showed a pattern arrangement as an example.

As shown in FIG. 4A, a test pattern 6-1 is a pattern composed of regions that are continuously arranged at equal distances along a medium conveyance direction and respectively correspond to tone degrees of 100%, 80%, 50%, 40%, 25% and 10%.

As shown in FIG. 4B, the test pattern 6-1 is printed on a part of the conveying belt 129 (FIG. 2) by the image forming section 1 (1C, 1M, 1Y, 1K) as passing just under the density sensor 6.

Figure 5:
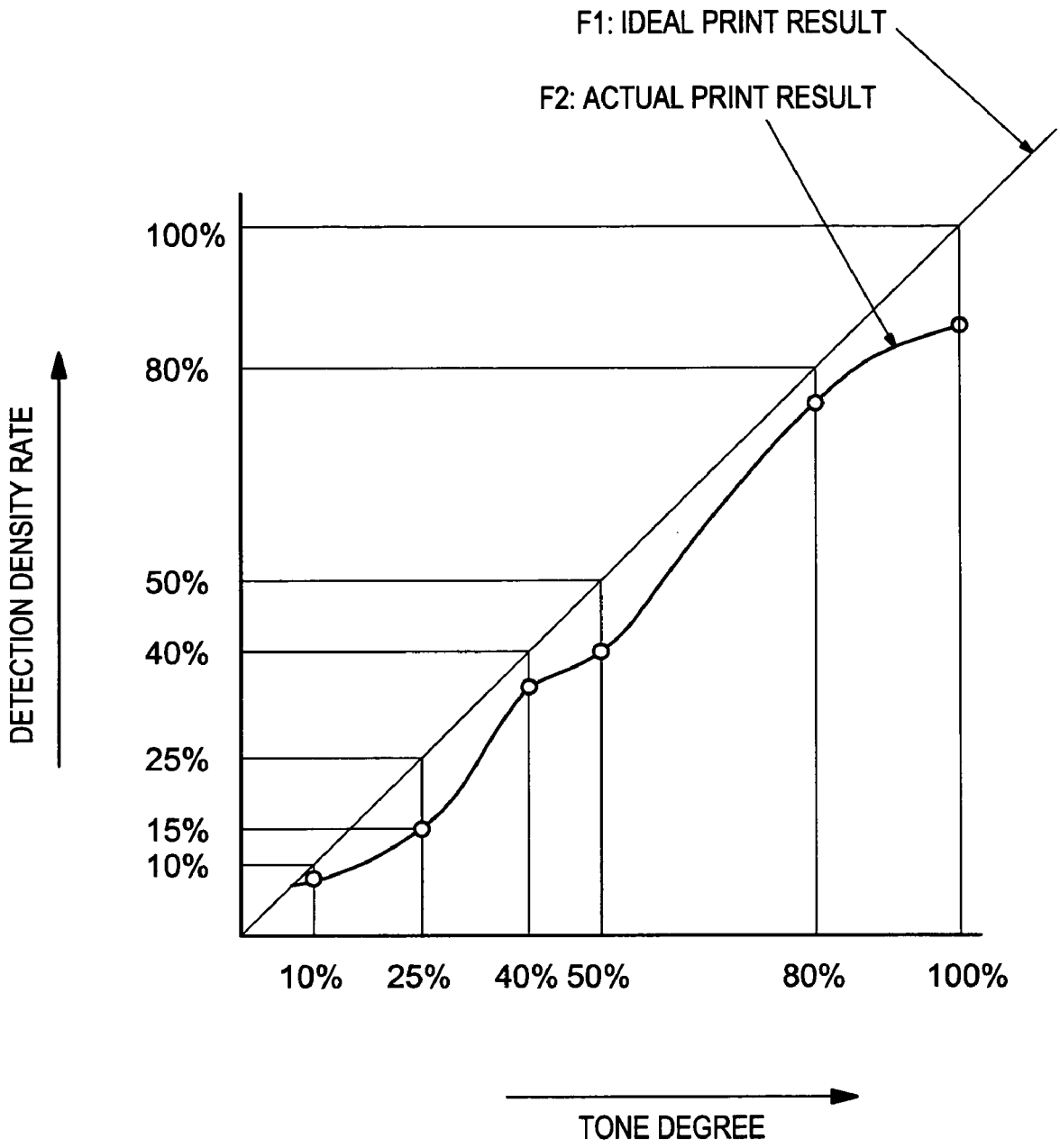
FIG. 5 is an explanation diagram of a detection result according to the test pattern for density correction use.

FIG. 5 is an explanation diagram of a detection result according to a test pattern for density correction use.

As shown in FIG. 5, a tone degree is represented by a horizontal axis, and a density rate detected by the density sensor 6 is represented by a vertical axis. An f1 is a straight line representing an ideal print result; and an f2 is a curve representing an actual print result. The revision calculating section 8 (FIG. 1) calculates a developing bias added onto the developing roller 124 (FIG. 2) of the image forming section 1 (FIG. 1), calculates a light emission quantity of the LED head 3 (FIG. 1) on the basis of a read density rate, and notifies the print controlling section 15 (FIG. 1) of the developing bias and the light emission quantity.

Here, when the difference of the density rates of the f1 and the f2 exceeds a predetermined value, it is judged that a correction is needed. In the case, the revision calculating section 8 must calculate the developing bias added on the developing roller 124 (FIG. 2) of the image forming section 1 (FIG. 1) and the light emission quantity of the LED head 3 (3C, 3M, 3Y, 3K) on the basis of the difference of the density rates, and inform the print controlling section 15 (FIG. 1) of the developing bias and the light emission quantity.

Figure 6A:
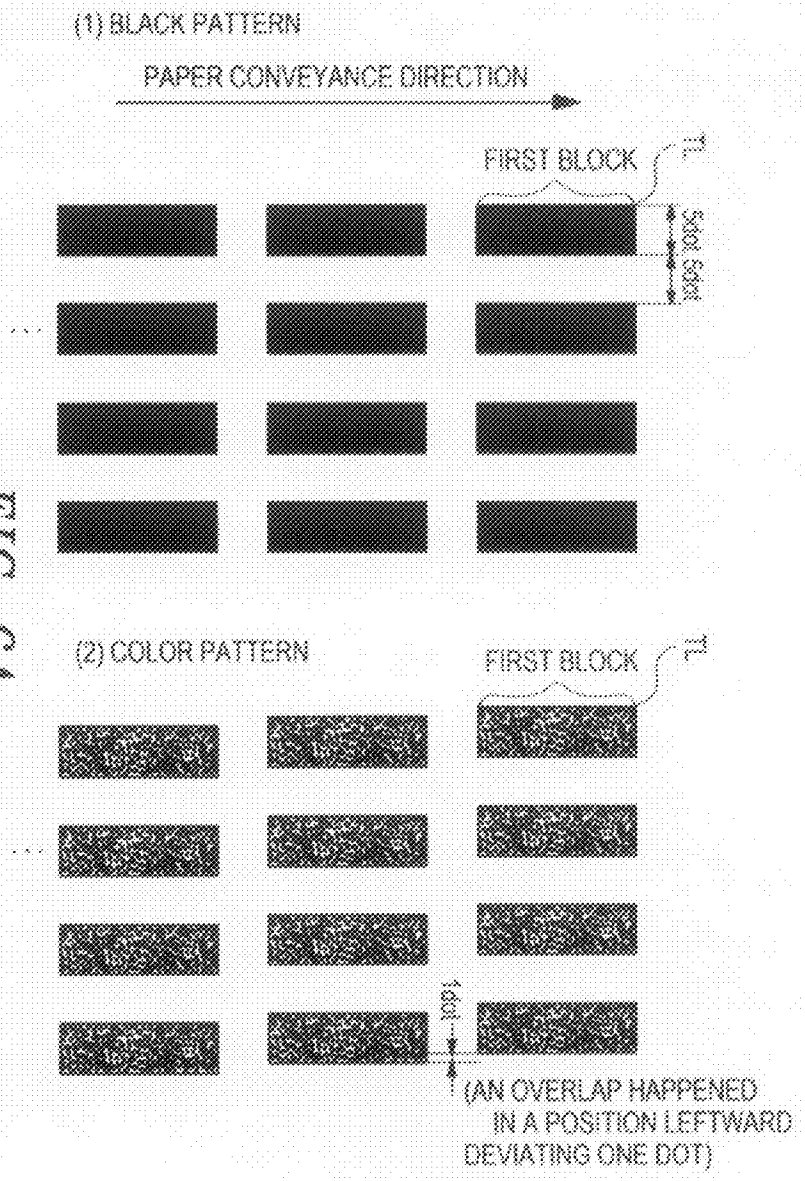
FIG. 6A is a first explanation diagram of the test pattern for color deviation correction use (I)
Figure 6B:
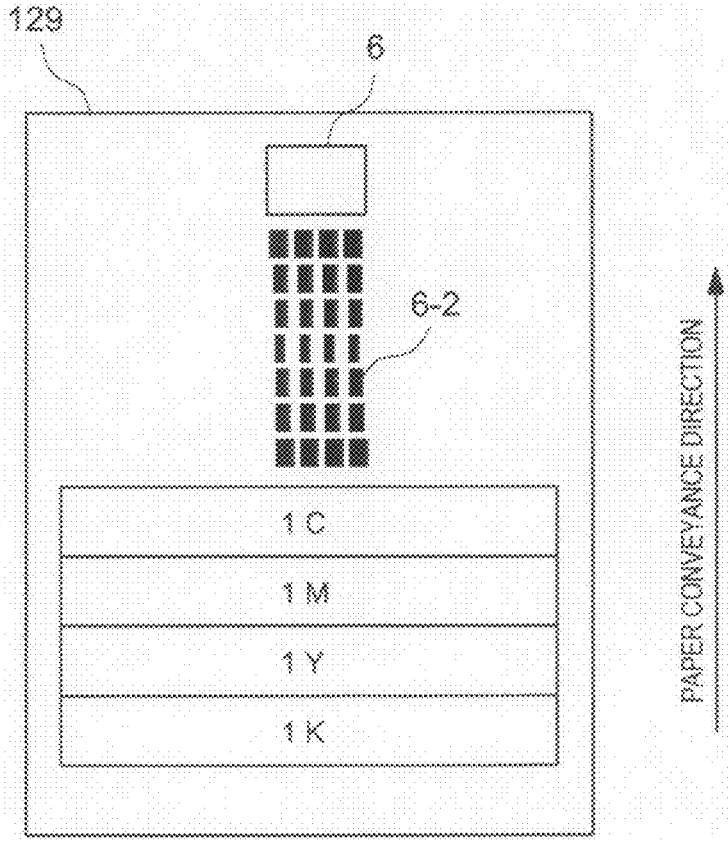
FIG. 6B is a first explanation diagram of the test pattern for color deviation correction use (II)

FIG. 6A is a first explanation diagram of a test pattern for the color deviation correction use (I); and FIG. 6B is a first explanation diagram of a test pattern for the color deviation correction use (II).

The FIG. 6A showed a pattern formation as an example, and the FIG. 6B showed a pattern arrangement as an example.

As shown in FIG. 6A, in (1) area, black patterns are represented; and in (2) area, color patterns are represented (any color of yellow, magenta and cyan). Here, though the black pattern and the color pattern are separately represented, in fact, the black pattern is initially printed on the conveying belt 129 (FIG. 2), then the color pattern of any color of yellow, magenta and cyan is printed as overlapping on the black pattern. In the drawing, the representations of fourth patterns and over counted from the head along the paper conveyance direction is omitted.

As shown in the (1) area, the initially printed black patterns are 4 pieces of patterns with striped shapes that respectively have a width of 5 dots and are arranged in an interval of 5 dots along a main movement direction of the print at right angles to the paper conveyance direction. When the 4 pieces of patterns with striped shapes serves as a block, along a subsidiary movement direction of the print (i.e. the conveying belt direction), 9 blocks are arranged in a predetermined interval and in a straight line. Moreover, the 4 pieces of striped pattern are placed in the same position in the main movement direction.

As shown in the (2) area, the arrangement of the color patterns and the block construction are the same as the black patterns. On the one hand, when a position TL at the left of the initially printed first block serves as a standard position, the print positions of the color pattern in the subsidiary movement direction are set as respectively coinciding with the black patterns. On the other hand, the print position of the first block of the color pattern in the main movement direction is set as leftward shifting 4 dots to compare with the first block of the black pattern; further, with respect to the second block and over of the color pattern, the print position of the latter block is set as rightward shifting 1 dot to compare with the former block.

As shown in FIG. 6B, a test pattern 6-2 is printed on a part of the conveying belt 129 (FIG. 2) by the image forming section 1 (1C, 1M, 1Y, 1K) as passing just under the density sensor 6.

That is, all of the black patterns and all of the color patterns are used as two kinds of detection use patterns, and the test pattern 6-2 is formed on the basis of the two kinds of detection use patterns. Moreover, these settings for printing the black patterns and the color patterns are previously stored in the image forming apparatus.

Figure 7A:
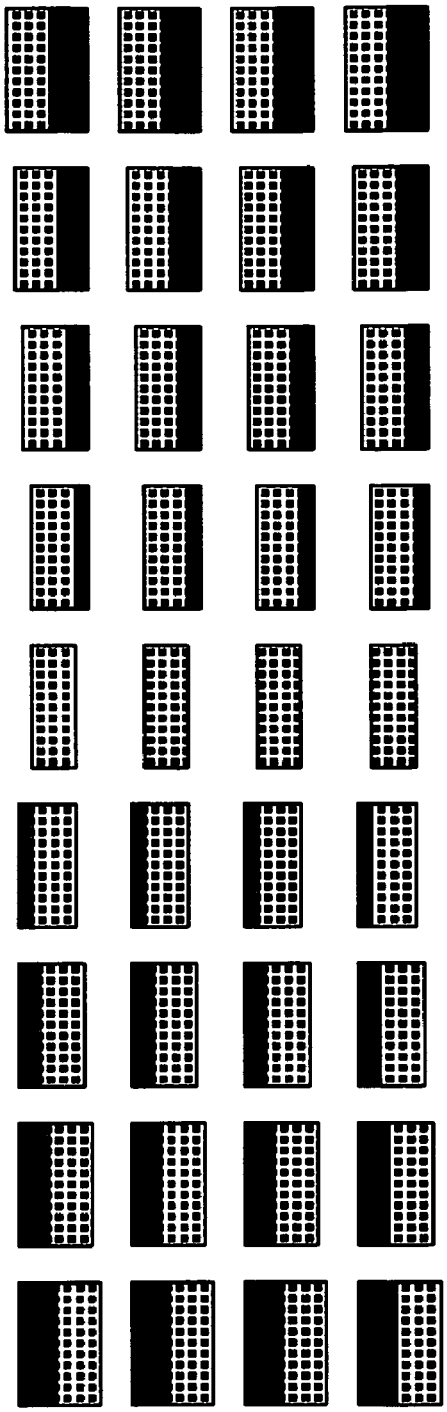
FIG. 7A is a second explanation diagram of the test pattern for color deviation correction use (I)
Figure 7B:
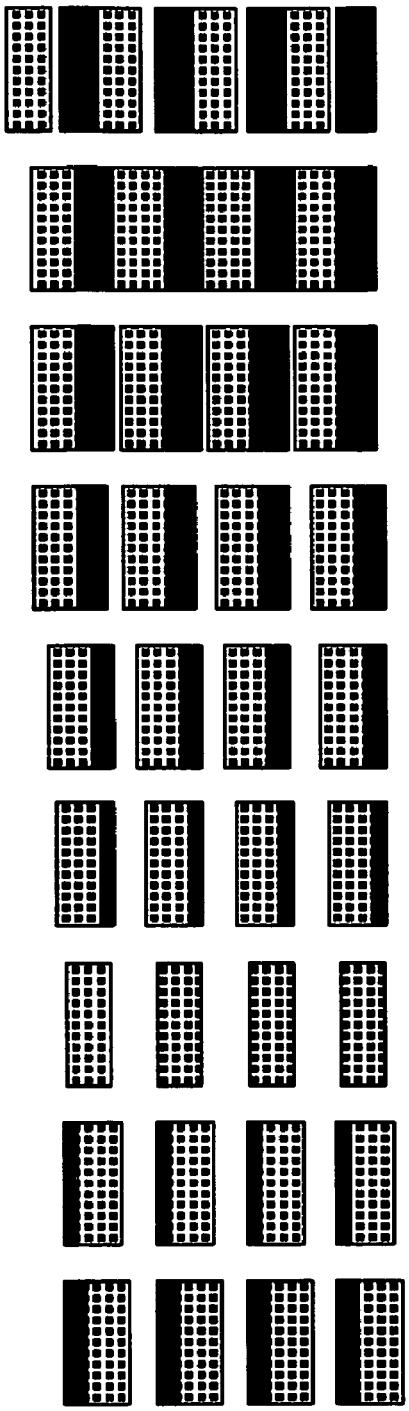
FIG. 7B is a second explanation diagram of the test pattern for color deviation correction use (II)

FIG. 7A is a second explanation diagram of a test pattern for the color deviation correction use (I); and FIG. 7B is a second explanation diagram of a test pattern for the color deviation correction use (II).

In the case that the color deviation did not happen, as shown in FIG. 7A, a test pattern serving as an ideal test pattern is composed of the striped black patterns and the color patterns set and arranged as stated above. That is, the test pattern is formed by covering the initially printed black patterns with the later printed color patterns. In the ideal test pattern, the ratio of the overlapping part between the black pattern and the color pattern changes per block, and in the fifth block, the black pattern and the color pattern are overlapping completely.

In the case that the color deviation happened, for example, the color pattern leftward deviates two dots with respect to the black pattern, as shown in FIG. 7B, a test pattern serving as an actual test pattern is formed. In the actual test pattern, the ratio of the overlapping part between the black pattern and the color pattern also changes per block, and in the seventh block, the black pattern and the color pattern become to overlap completely.

As stated above, when the color deviation (i.e. the position deviation) happened, the block number of the blocks in which the black pattern and the color pattern become to overlap completely is changed.

Moreover, when using 9 blocks to test the color deviation, if only the deviation does not exceed 4 dots, it is possible to detect the deviation. Furthermore, because such test pattern stated above is printed on the conveying belt 129 and is not fixed, in overlapping part, the black pattern is completely covered by the color pattern.

Because the density of the printed test pattern changes according to an overlapping condition between the black pattern and the color pattern, through the density sensor 6 reads the density, a color deviation quantity is detected. The revision calculating section 8 (FIG. 1) calculates a color deviation quantity (i.e. a print position correction quantity) on the basis of the density read by the density sensor 6 (FIG. 1), and notifies the print controlling section 15 (FIG. 1) of the print position correction quantity. In the case that the color deviation quantity exceeds a predetermined quantity, the print controlling section 15 (FIG. 1) controls the LED head controlling section 4 to correct the print position of image data. The correction is executed when the LED head controlling section 4 adjusts in exactly the emitting timing of the LED head 3 (3C, 3M, 3Y, 3K).

Figure 8A:
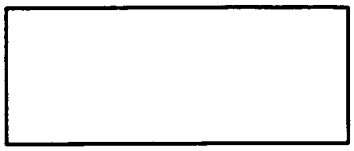
FIG. 8A is a first explanation diagram of oligomer adhesion detection pattern (I)
Figure 8B:
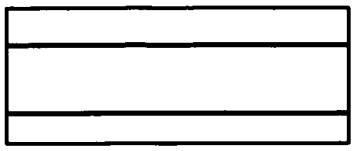
FIG. 8B is a first explanation diagram of oligomer adhesion detection pattern (II)
Figure 9A:
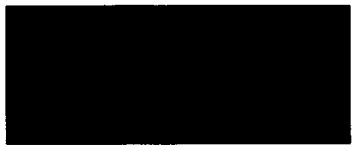
FIG. 9A is a second explanation diagram of oligomer adhesion detection pattern (I)

FIG. 8A is a first explanation diagram of the oligomer adhesion detection pattern (I); FIG. 8B is a first explanation diagram of the oligomer adhesion detection pattern (II); FIG. 9A is a second explanation diagram of the oligomer adhesion detection pattern (I); and FIG. 9B is a second explanation diagram of the oligomer adhesion detection pattern (II).

The FIGS. 8A and 8B show a method for not forming a test pattern on the conveying belt 129. The conveying belt 129 without any printing is showed in the FIG. 8. When an oligomer is formed on the photosensitive drum, because toner adheres to the oligomer, as shown in FIG. 8B, a black line occurs.

Figure 9B:
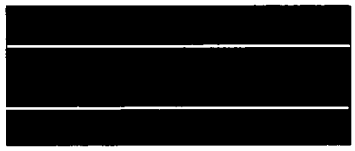
FIG. 9B is a second explanation diagram of oligomer adhesion detection pattern (II)

The FIGS. 9A and 9B show a method of forming a test pattern on the conveying belt 129. The conveying belt 129 on which a black pattern is printed all over is showed in FIG. 9. When an oligomer is formed on the photosensitive drum and the corresponding part is not exposed, as shown in FIG. 9B, a white line occurs.

In the case that such black/white line occurs, after the density sensor 6 reads the black/white line, a density value changes per cycle of the drum. The revision calculating section 8 (FIG. 1) detects an adhesion of the oligomer on the basis of the density read by the density sensor 6 (FIG. 1), and notifies the print controlling section 15 of the adhesion of the oligomer. When a density change quantity is at or over a predetermined value, the print controlling section 15 (FIG. 1) makes the photosensitive drum 123 (123K, 123Y, 123M or 123C) idly rotate so as to remove the oligomer.

Figure 10A:
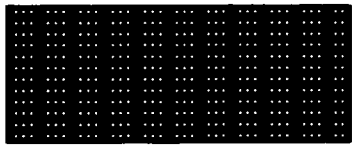
FIG. 10A is an explanation diagram of the test pattern for toner degradation detection use (I)
Figure 10B:
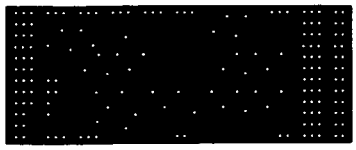
FIG. 10B is an explanation diagram of the test pattern for toner degradation detection use (II)

FIG. 10A is an explanation diagram of a test pattern for the toner degradation detection use (I); and FIG. 10B is an explanation diagram of a test pattern for the toner degradation detection use (II).

The FIG. 10A shows an ideal test pattern formed by printing a black pattern on the conveying belt 129 all over. In the case that a toner has degraded so that the toner is not charged or is charged over a necessary value, as shown in FIG. 10B, a color unevenness happens. That is, in the FIG. 10B, an actual test pattern serving as a color unevenness pattern is shown.

When the toner degrades and the density sensor 6 (FIG. 1) reads the color unevenness pattern, a density value irregularly changes. The revision calculating section 8 (FIG. 1) detects a degradation of the toner on the basis of the density read by the density sensor 6 (FIG. 1), and notifies the print controlling section 15 of the adhesion of the oligomer. When a density change quantity is at or over a predetermined value, the print controlling section 15 (FIG. 1) reads a black pattern from the test pattern storing section 5 and prints the block pattern on a record medium all over so as to output the degradation toner from the photosensitive drum 123.

Moreover, all patterns for detecting the oligomer adhesion or detecting the toner degradation are printed by the image forming section 1 (1C, 1M, 1Y, 1K) onto a part of the conveying belt 129 (FIG. 2) and passed just under the density sensor 6 (FIG. 1), like the density correction and the color deviation correction. The following is to continue the explanation of the components by returning to the FIG. 1.

The receiving section 9 is a part to receive print data from a not shown host computer and to inform the time information obtaining section 11 of the receiving of the print data together with sending the print data to the image processing section 16.

The power source on-operation detecting section 10 is a part to inform the time information obtaining section 11 of power source on-operation information when a power source is turned on. The time information obtaining section 11 is a part to obtain time information from the clock section 12 and to store the time information into the time information storing section 13 together with sending the time information to the non-operation time calculating section 14 when a notification is received form the receiving section 9 or the power source on-operation detecting section 10.

The clock section 12 is a part to inform the time information obtaining section 11 of current time information. The time information storing section 13 is a volatile memory to store the time information obtained by the time information obtaining section 11.

The non-operation time calculating section 14 is a part to read the time information stored in the time information storing section 13, to calculate a non-operation time from the last print to the current, and to send the time to the print controlling section 15 when receiving the time information from the time information obtaining section 11.

The print controlling section 15 is a part to make the printing machinery section operate to perform a print process when receiving a print start notification of the image processing section 16. The print controlling section 15 is also a part to refer to the test pattern table storing section 7 when receiving the non-operation time from the non-operation time calculating section 14, to read out a test pattern from the test pattern storing section 5 if the non-operation time is a time capable of meeting one of respective test execution conditions, and to print the test pattern onto the conveying belt 129. Further, the print controlling section 15 is a part to receive color deviation correction data from the revision calculating section 8, to notify the developing bias controlling section 2 to set a developing bias of correction later, and to notify the LED head controlling section 4 to set an LED emitting quantity of the correction later. Further, the print controlling section 15 is a part to make the photosensitive drum 123 (123K, 123Y, 123M and 123C) rotate and perform a control to remove the oligomer, when receiving an oligomer detection notification from the revision calculating section 8. Furthermore, the print controlling section 15 is a part to perform a process to output the degrading toner from the photosensitive drum 123 by reading out a black pattern to be print all over from the test pattern storing section 5 and printing the black pattern onto a record medium, when receiving a toner degradation detection notification from the revision calculating section 8.

The image processing section 16 is a part to perform a process to convert print data received by the receiving section 9 into a image data form recorded onto the record medium, and to send the image data to the LED head controlling section 4 together with notifying the print controlling section 15 of a start of the print operation.

The image forming apparatus 200 (i.e. printing apparatus) explained above operates as follows.

Explanation of Operation

Figure 11A:
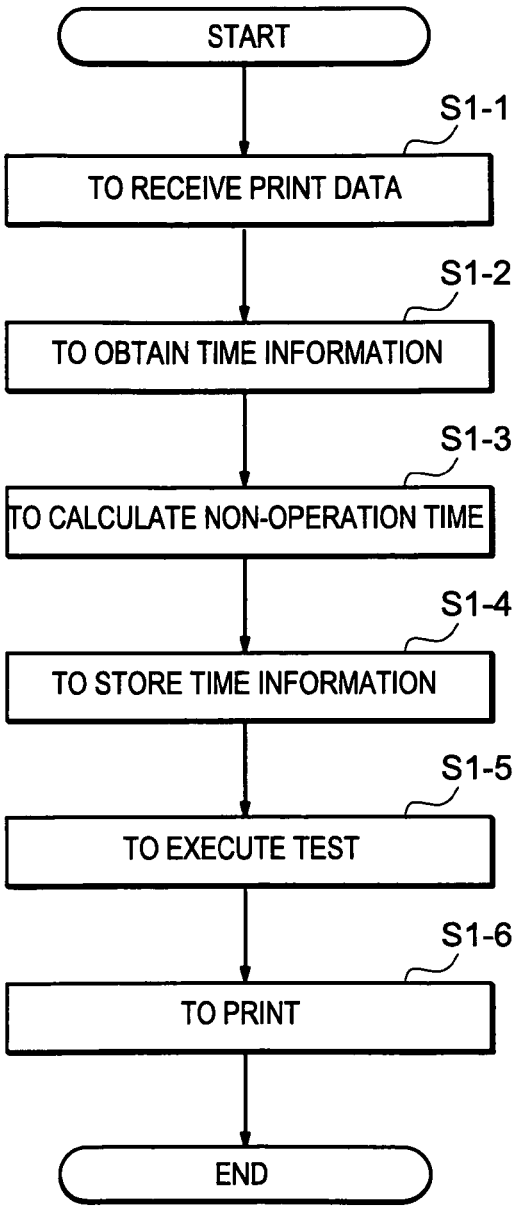
FIG. 11A is a flowchart showing all operations in embodiment 1 (I)
Figure 11B:
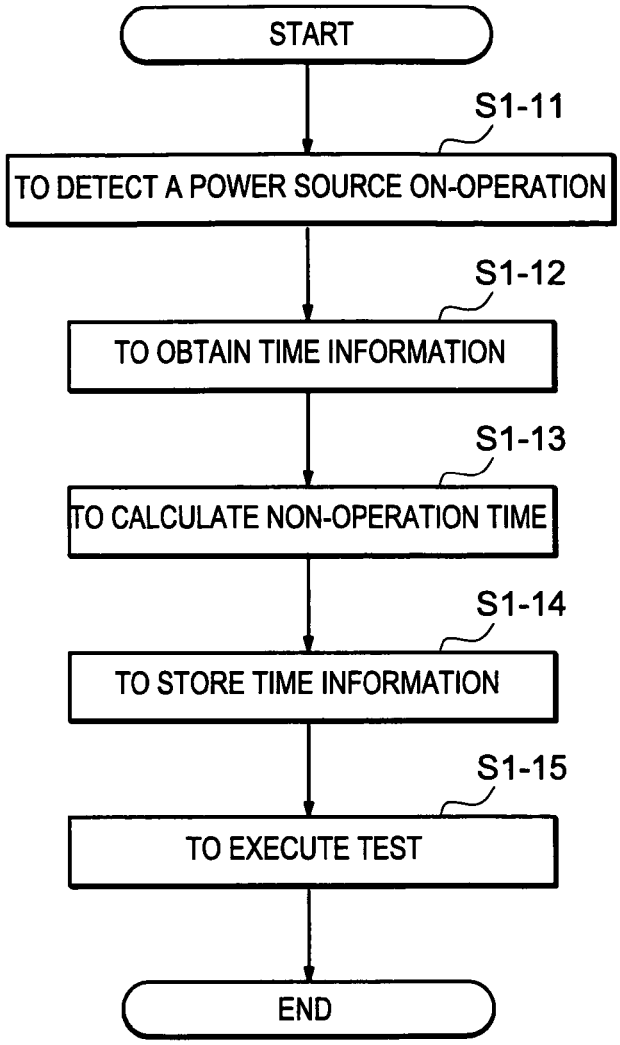
FIG. 11B is a flowchart showing all operations in embodiment 1 (II)

FIG. 11A is a flowchart showing all operations in embodiment 1 (I); and FIG. 11B is a flowchart showing all operations in embodiment 1 (II).

The FIG. 11A shows operation when receiving print data, and the FIG. 11B shows operation when turning on a power source.

Initially, regarding operations from a receiving of print data from an external apparatus to a test execution, it will be explained in detail according to a step order from step 1-1 to step 1-6, together with using FIG. 1.

Step 1-1

When the receiving section 9 receives the print data from a not shown host PC (i.e. host apparatus), the receiving section 9 sends the print data to the image processing section 16 and notifies the time information obtaining section 11 of a receiving of the print data.

Step 1-2

The time information obtaining section 11 obtains current time information from the clock section 12 and notifies the non-operation time calculating section 14 of the current time information.

Step 1-3

The non-operation time calculating section 14 refers to the time information notified from the time information obtaining section 11 and the time information of the last print stored in the time information storing section 13, calculates a non-operation time representing the time that the printing apparatus did not operate from the last print, and notifies the print controlling section 15 of the non-operation time.

Step 1-4

The time information obtaining section 11 stores the time information obtained in the step 1-2 into the time information storing section 13.

Step 1-5

The print controlling section 15 controls whether to perform a print quality test on the basis of the non-operation time information notified from the non-operation time calculating section 14, then performs various kinds of tests. Regarding this step, it will be explained below in detail once more.

Step 1-6

The image processing section 16 converts the print data into image data and notifies the print controlling section 15 of a start of a print together with sending the image data to the LED head controlling section 4, then performs a print of the record medium and ends the flow.

Continuously, regarding operations from when the power source of the image forming apparatus 200 is turned on to a test execution, it will be explained in detail according to a step order from step 1-11 to step 1-15, together with using FIG. 1.

Step 1-11

The power source on-operation detecting section 10 detects that the power source is turned on and notifies the time information obtaining section 11 of the on-operation of the power source.

Step 1-12

The time information obtaining section 11 obtains current time information from the clock section 12 and notifies the non-operation time calculating section 14 of the current time information. The step is the same as the step 1-2.

Step 1-13

The non-operation time calculating section 14 refers to the time information notified from the time information obtaining section 11 and the time information of the last print stored in the time information storing section 13, calculates a non-operation time representing the time that the printing apparatus did not operate from the last print, and notifies the print controlling section 15 of the non-operation time. The step is the same as the step 1-3.

Step 1-14

The time information obtaining section 11 stores the time information obtained in the step 1-13 into the time information storing section 13.

Step 1-15

The print controlling section 15 controls whether to perform a print quality test on the basis of the non-operation time information notified from the non-operation time calculating section 14, then performs various kinds of tests and ends the flow. Regarding this step, it is the same as the step 1-5 and will be explained below in detail once more.

Next is to explain the step 1-5 (i.e. step 1-15) in the above stated flowchart.

Figure 12:
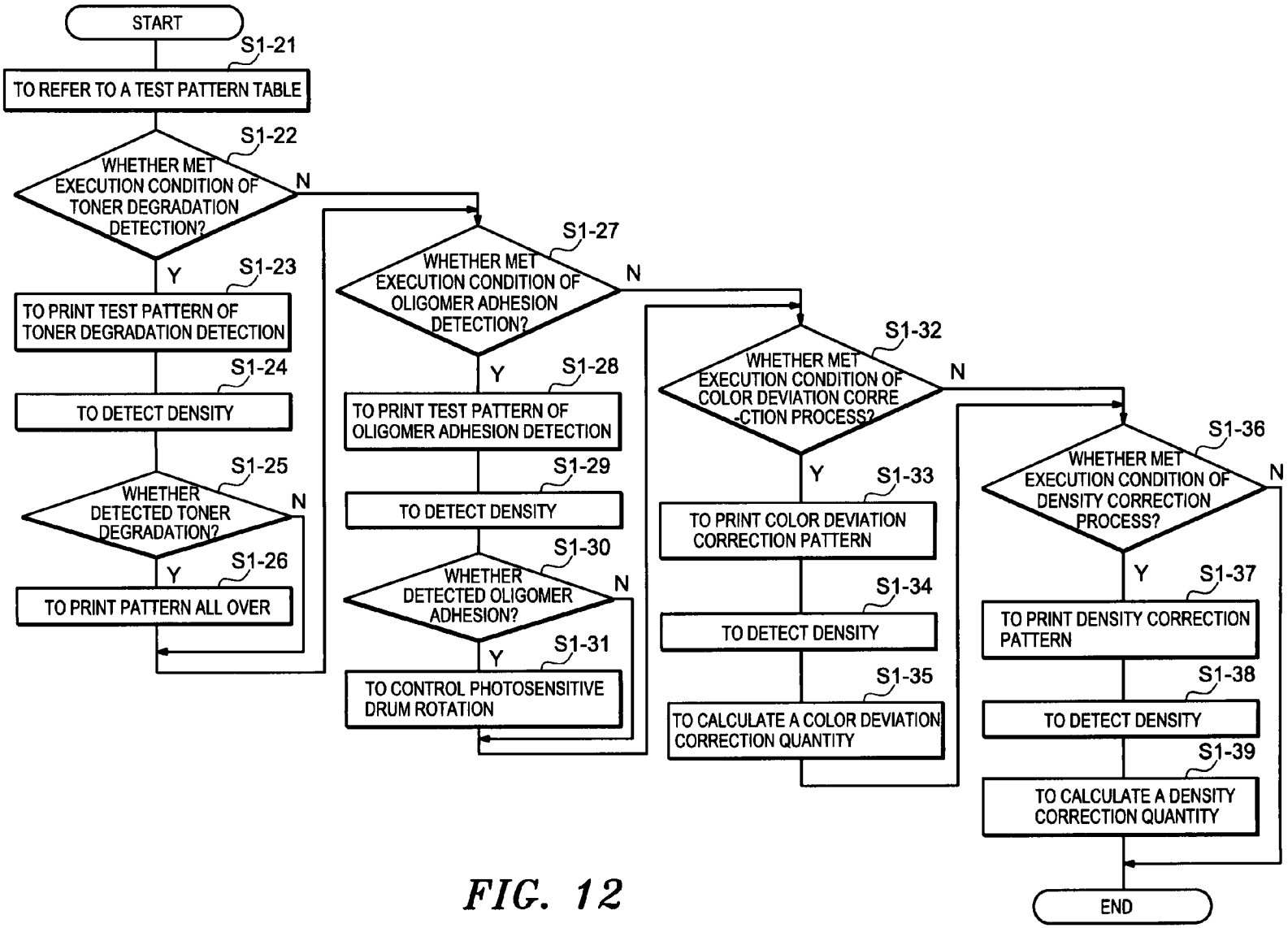
FIG. 12 is a flowchart showing operations of steps 1~5 in detail in embodiment 1.

FIG. 12 is a flowchart showing operations of steps 1~5 in detail in embodiment 1.

Regarding the operation that the print controlling section 15 performs various kinds of tests on the basis of the non-operation time information notified from the non-operation time calculating section 14, it is explained in detail according to a step order from step 1-21 to step 1-39.

Step 1-21

The print controlling section 15 refers to the test pattern table storing section 7.

Step 1-22

The print controlling section 15 judges whether the non-operation time obtained in step 1-3 meets a condition to execute a toner degradation detection test or not. That is to judge whether the non-operation time is or has exceeded one month. If it meets, step 1-23 will be performed; and if it does not meet, step 1-27 will be performed.

Step 1-23

The print controlling section 15 prints a test pattern of the toner degradation detection (FIG. 10) onto the conveying belt 129 (FIG. 2) through referring to the test pattern storing section 5.

Step 1-24

The density sensor 6 reads the test pattern of the toner degradation detection (FIG. 10) which is printed in the step 1-23.

Step 1-25

The revision calculating section 8 judges whether the toner has degraded from a density value read out by the density sensor 6. If the toner has degraded, step 1-26 is performed; if the toner has not degraded, step 1-27 is performed.

Step 1-26

The revision calculating section 8 notifies the print controlling section 15, and the print controlling section 15 prints a black pattern all over onto a record medium in order to output the degraded toner. At that time, the number of papers to be printed is decided according to the non-operation time (the number of days of non-operation×20).

Step 1-27

When it does not meet the condition in step 1-22 or when the toner is judged that it has not degraded yet in step 1-25 or when the process of step 1-26 ends, the print controlling section 15 judges whether the non-operation time obtained in step 1-3 meets a condition to execute an oligomer adhesion detection test or not. That is to judge whether the non-operation time is or has exceeded one week. If it meets, step 1-28 will be performed; and if it does not meet, step 1-32 will be performed.

Step 1-28

The print controlling section 15 prints a test pattern of the oligomer adhesion detection (FIG. 8 or FIG. 9) onto the conveying belt 129 (FIG. 2) through referring to the test pattern storing section 5.

Step 1-29

The density sensor 6 reads the test pattern of the oligomer adhesion detection (FIG. 8 or FIG. 9) which is printed in the step 1-28.

Step 1-30

The revision calculating section 8 judges whether the oligomer is adhering to the photosensitive drum 123 from a density value read out by the density sensor 6. If the oligomer is adhering, step 1-31 is performed; if the oligomer is not adhering, step 1-32 is performed.

Step 1-31

The revision calculating section 8 notifies the print controlling section 15, and the print controlling section 15 controls the photosensitive drum 123 (123K, 123Y, 123M or 123C) (FIG. 2) to rotate in order to remove the oligomer.

Step 1-32

When it does not meet the condition in step 1-27 or when the oligomer does not adhere to in step 1-30 or when the process of step 1-31 ends, the print controlling section 15 judges whether the non-operation time obtained in step 1-3 meets a condition to execute a color deviation correction or not. That is to judge whether the non-operation time is or has exceeded one day. If it meets, step 1-33 will be performed; and if it does not meet, step 1-36 will be performed.

Step 1-33

The print controlling section 15 prints a test pattern for color deviation correction use (FIG. 6 or FIG. 7) onto the conveying belt 129 (FIG. 2) through referring to the test pattern storing section 5.

Step 1-34

The density sensor 6 reads the test pattern for the color deviation correction use (FIG. 6 or FIG. 7) which is printed in the step 1-33.

Step 1-35

The revision calculating section 8 calculates a color deviation correction value and notifies the print controlling section 15, the print controlling section 15 controls the LED head controlling section 4 to update a correction value according to the calculated color deviation correction value.

Step 1-36

When it does not meet the condition in step 1-32 or when the process of step 1-35 ends, the print controlling section 15 judges whether the non-operation time obtained in step 1-3 meets a condition to execute a density correction or not. That is to judge whether the non-operation time is or has exceeded three hours. If it meets, step 1-37 will be performed; and if it does not meet, the flow is ended.

Step 1-37

The print controlling section 15 prints a test pattern for the density correction use (FIG. 4) onto the conveying belt 129 (FIG. 2) through referring to the test pattern storing section 5.

Step 1-38

The density sensor 6 reads the test pattern for the density correction use (FIG. 4) which is printed in the step 1-37.

Step 1-39

The revision calculating section 8 calculates a density correction value and notifies the print controlling section 15; the print controlling section 15 controls the developing bias controlling section 2 and the LED head controlling section 4 to update the correction value according to the calculated density correction value, then ends the flow.

Explanation of Effect

As explained above, according to the embodiment, because only necessary process is performed on the basis of a passage time through calculating a non-operation time of the image forming apparatus and changing the test to be executed according to the calculated non-operation time, it is possible to reduce the waiting time of an user.

Moreover, in the above explanation, the number of the print papers for printing black pattern all over is regular, but it may be set to be variable. Further, the calculation expression is used in the embodiment, but it is not absolute, it may be used to set an upper limitation of the number of print papers. Further, in the embodiment, the color deviation correction only in a main movement direction is explained, but color deviation correction in other direction such as a subsidiary movement direction or a skew direction or the like may also be performed. Further, in the embodiment, the respective processes are performed by using a density sensor, but other methods may be used. Further, it is possible to add other operation tests that are not stated in the embodiment into the test pattern table.

Embodiment 2

Figure 13:
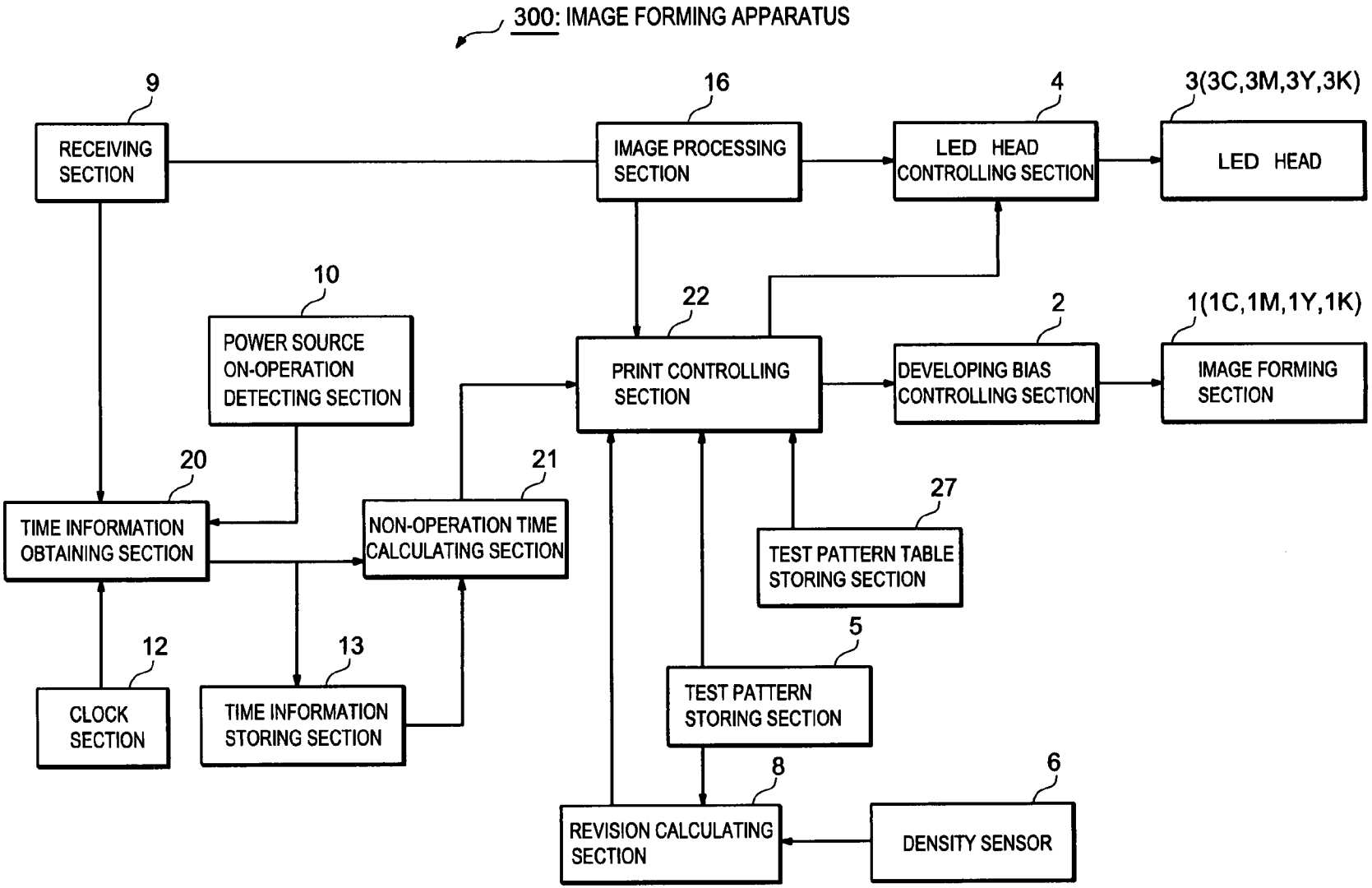
FIG. 13 is a block diagram showing a controlling system of a printing apparatus in embodiment 2.

FIG. 13 is a block diagram showing a controlling system of a printing apparatus in embodiment 2.

As shown by FIG. 13, a controlling system of a printing apparatus 300 serving as an image forming apparatus of the present invention comprises a image forming section 1 (1C, 1M, 1Y, 1K), a developing bias controlling section 2, LED head 3 (3C, 3M, 3Y, 3K), a LED head controlling section 4, a test pattern storing section 5, a density sensor 6, a test pattern table storing section 27, a revision calculating section 8, a receiving section 9, a power source on-operation detecting section 10, a time information obtaining section 20, a clock section 12, a time information storing section 13, a non-operation time calculating section 21, a print controlling section 22 and an image processing section 16. In the following, only components different from the embodiment 1 are explained in detail. Regarding the same components as those in the embodiment 1, their explanations will be omitted and their symbols will be identically set.

The time information obtaining section 20 is a part to obtain time information from the clock section 12 and to store the time information into the time information storing section 13 together with sending the time information to the non-operation time calculating section 21 when receiving a notification form the receiving section 9 or the power source on-operation detecting section 10. Further, the time information obtaining section 20 also is a part to notify the non-operation time calculating section 21 of power source on-operation information expressing whether a notification is received from the power source on-operation detecting section 10. Here, the power source on-operation information has two states of "power source on-operation" and "in continuous operation".

The non-operation time calculating section 21 is a part to read the time information stored in the time information storing section 13, calculate a non-operation time from last print to the current and send the time to the print controlling section 22 together with the power source on-operation information, when receiving the time information and the power source on-operation information from the time information obtaining section 20.

The print controlling section 22 is a part to make the printing machinery section operate to perform a print process when receiving a print start notification of the image processing section 16. The print controlling section 22 is also a part to refer to the test pattern table storing section 27 when receiving the non-operation time and the power source on-operation information from the non-operation time calculating section 21, read out a test pattern from the test pattern storing section 5 if the non-operation time is a time capable of meeting one of respective test execution conditions, and print the test pattern onto the conveying belt 129. Further, the print controlling section 22 is a part to receive color deviation correction data from the revision calculating section 8 and notify the developing bias controlling section 2 to set a developing bias of correction later and notify the LED head controlling section 4 to set an LED emitting quantity of correction later. Further, the print controlling section 22 is a part to make the photosensitive drum 123 (123K, 123Y, 123M and 123C) rotate and perform a control to remove the oligomer, when receiving an oligomer detection notification from the revision calculating section 8. Furthermore, the print controlling section 22 is a part to perform a process to output the degrading toner from the photosensitive drum 123 by reading out a black pattern to be print all over from the test pattern storing section 5 and printing the black pattern onto a record medium, when receiving a toner degradation detection notification from the revision calculating section 8.

The test pattern table storing section 27 is a part to previously store respective execution contents for executing tests according to different non-operation times that the printing apparatus is left without executing print. Here, the contents (as an example) of a test pattern table will be explained.

FIG. 14 is an explanation diagram of a test pattern table in embodiment 2.

As shown by FIG. 14, a test pattern table stores a relation among a test execution condition in which a print end time serves as a start point, a test execution condition in which a power source on-operation time serves as a start point, and a test pattern used for the test.

As represented in the test pattern table, in the case that the non-operation time is one month or more, a toner degradation detection will be performed. Likewise, in the case that the non-operation time is one week or more, an oligomer adhesion detection will be performed; in the case that the non-operation time is one day or more, a color deviation adjustment will be performed; and in the case that the non-operation time is three hours or more, a density correction will be performed.

Further, in the case that once the power source is turned off, after it is turned on again, if the non-operation time is twenty days or more, a toner degradation detection test will be performed. Likewise, if the non-operation time is five days or more, an oligomer adhesion detection test will be performed; if the non-operation time is twelve hours or more, a color deviation adjustment will be performed; if the non-operation time is less than twelve hours, a density correction test will be performed. As illustrated in FIG. 14, the non-operation time when the image forming apparatus is turned off and then turned on again is set to be smaller than the non-operation time when the image forming apparatus is always on.

The following is to explain operations of the image forming apparatus 300 (i.e. printing apparatus).

Explanation of Operation

Figure 15A:
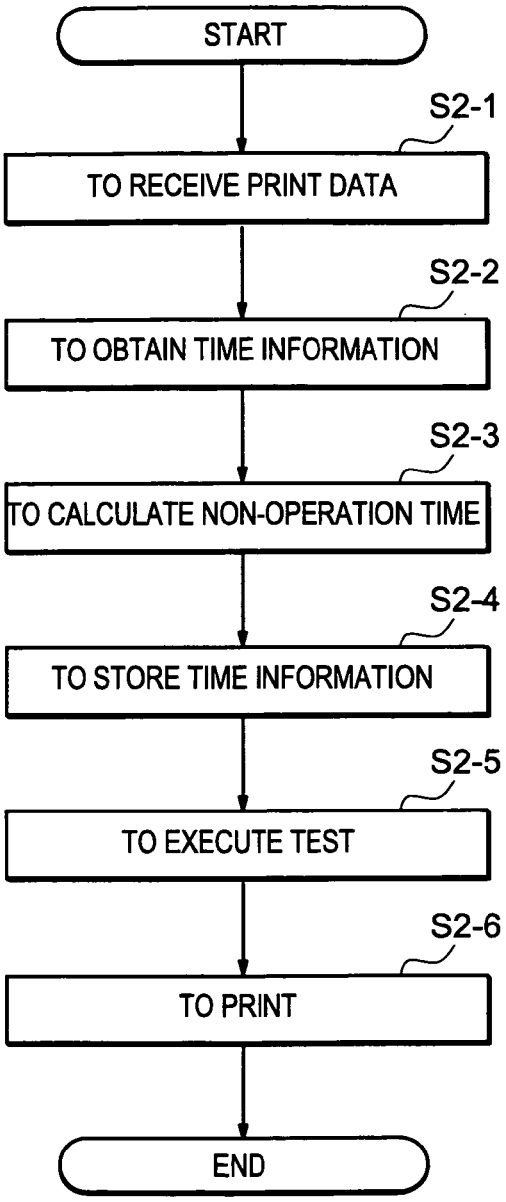
FIG. 15A is a flowchart showing all operations in embodiment 2 (I)
Figure 15B:
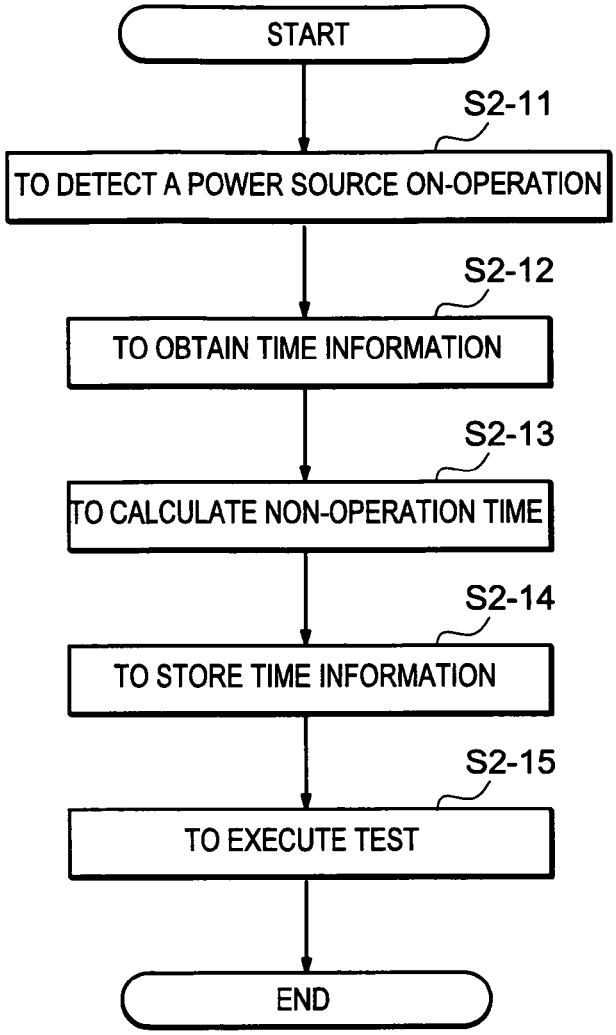
FIG. 15B is a flowchart showing all operations in embodiment 2 (II)

FIG. 15A is a flowchart showing all operations in embodiment 2 (I); and FIG. 15B is a flowchart showing all operations in embodiment 2 (II).

The FIG. 11A shows operation when receiving print data, and the FIG. 11B shows operation when turning on power source.

Initially, regarding operations from a receiving of print data from an external apparatus to a test execution, it will be explained in detail according to a step order from step 2-1 to step 2-6, together with using FIG. 13.

Step 2-1

When the receiving section 9 received print data from a not shown host PC (i.e. host apparatus), the receiving section 9 sends the print data to the image processing section 16 and notifies the time information obtaining section 20 of the receiving of the print data.

Step 2-2

The time information obtaining section 20 obtains current time information from the clock section 12 and notifies the non-operation time calculating section 21 of the current time information and power source on-operation information.

Step 2-3

The non-operation time calculating section 21 refers to the time information notified from the time information obtaining section 20 and the time information of the last print stored in the time information storing section 13, calculates a non-operation time representing the time that the printing apparatus did not operate from the last print, and notifies the print controlling section 22 of the non-operation time together with the power source on-operation information received in the step 2-2.

Step 2-4

The time information obtaining section 20 stores the time information obtained in the step 2-2 and the power source on-operation information into the time information storing section 13.

Step 2-5

The print controlling section 22 controls whether to perform a print quality test on the basis of the non-operation time information and the power source on-operation information notified from the non-operation time calculating section 21, then performs various kinds of tests. Regarding this step, it will be explained below in detail once more.

Step 2-6

The image processing section 16 converts the print data into image data and notifies the print controlling section 22 of a start of the print together with sending the image data to the LED head controlling section 4, then performs a print of the record medium and ends the flow.

Continuously, regarding operations from that the power source of the image forming apparatus 300 is turned on to a test execution, it will be explained in detail according to a step order from step 2-11 to step 2-15, together with using FIG. 13.

Step 2-11

The power source on-operation detecting section 10 detects that the power source is turned on and notifies the time information obtaining section 20 of the on-operation of the power source.

Step 2-12

The time information obtaining section 20 obtains current time information from the clock section 12 and notifies the non-operation time calculating section 21 of the current time information together with the power source on-operation information. The step is the same as the step 2-2.

Step 2-13

The non-operation time calculating section 21 refers to the time information notified from the time information obtaining section 20 and the time information of the last print stored in the time information storing section 13, calculates a non-operation time representing the time that the printing apparatus did not operate from the last print, and notifies the print controlling section 22 of the non-operation time together with the power source on-operation information received in the step 2-12. The step is the same as the step 2-3.

Step 2-14

The time information obtaining section 20 stores the time information obtained in the step 2-12 and the power source on-operation information into the time information storing section 13. The step is the same as the step 2-4.

Step 2-15

The print controlling section 22 controls whether to perform a print quality test on the basis of the non-operation time information and the power source on-operation information notified from the non-operation time calculating section 21, then performs various kinds of tests and ends the flow. Regarding this step, it is the same as the step 2-5 and will be explained below in detail once more.

Next is to explain the step 2-5 (i.e. step 2-15) in the above stated flowchart.

Figure 16:
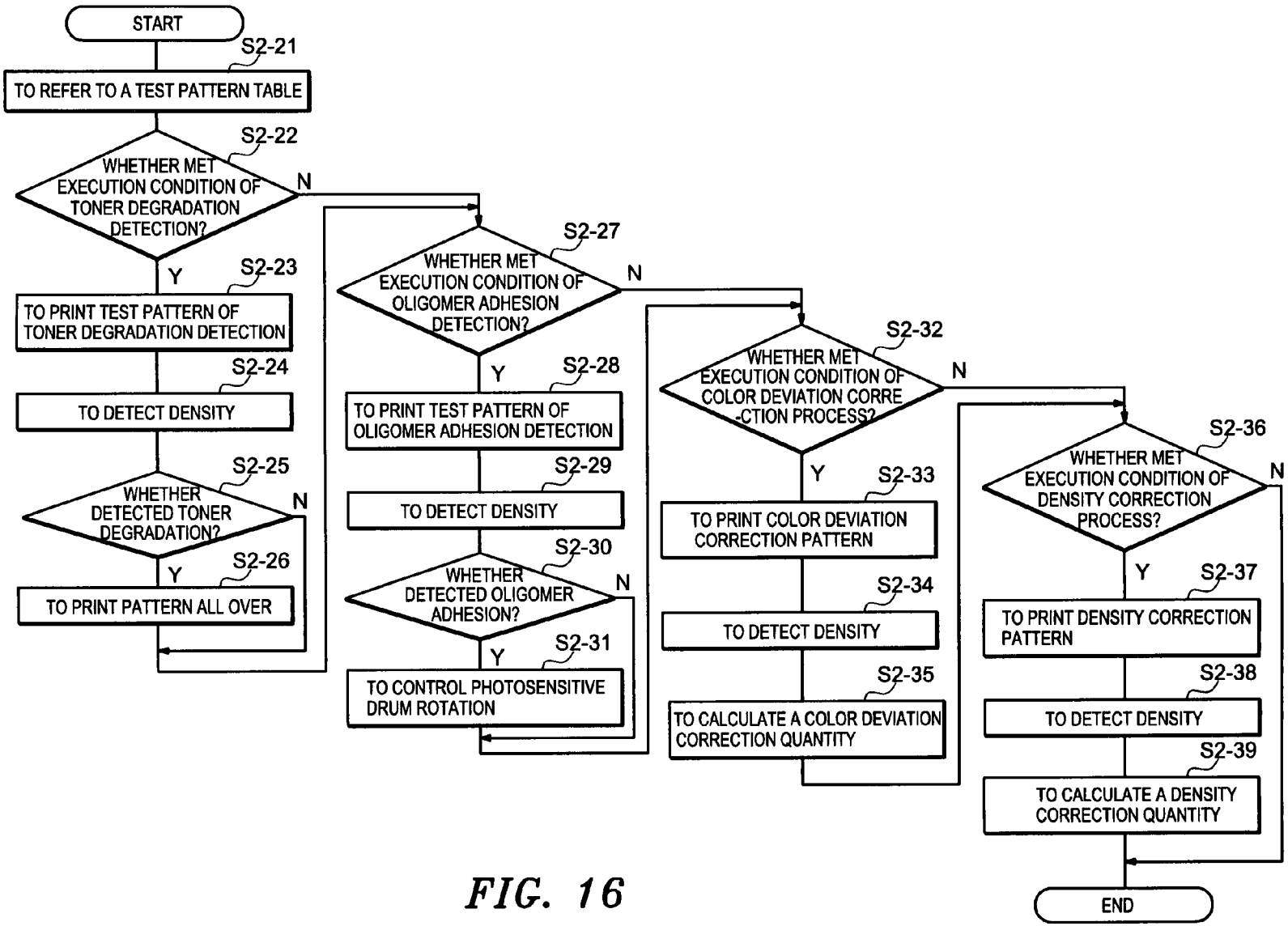
FIG. 16 is a flowchart showing operations of steps 2~5 in detail in embodiment 2.

FIG. 16 is a flowchart showing operations of steps 2~5 in detail in embodiment 2.

Regarding operation that the print controlling section 22 performs various kinds of tests on the basis of the non-operation time information notified from the non-operation time calculating section 21, it is explained in detail according to a step order from step 2-21 to step 2-39.

Step 2-21

The print controlling section 22 refers to the test pattern table storing section 27.

Step 2-22

The print controlling section 22 judges whether the non-operation time obtained in step 2-3 meets a condition to execute a toner degradation detection test or not. That is to judge whether the non-operation time in a continuous operation state is or has exceeded one month (i.e. the power source on-operation information is "in continuous operation" and the non-operation time is one month or more); or to judge whether the non-operation time after the power source is turned on again is or has exceeded twenty days (i.e. the power source on-operation information is "power source on-operation" and the non-operation time is twenty days or over). If it meets, step 2-23 will be performed; and if it does not meet, step 2-27 will be performed.

Step 2-23

The print controlling section 22 prints a test pattern of the toner degradation detection (FIG. 10) onto the conveying belt 129 (FIG. 2) through referring to the test pattern storing section 5.

Step 2-24

The density sensor 6 reads the test pattern of the toner degradation detection (FIG. 10) which is printed in the step 2-23.

Step 2-25

The revision calculating section 8 judges whether the toner has degraded from a density value read out by the density sensor 6. If the toner has degraded, step 2-26 is performed; if the toner has not degraded, step 2-27 is performed.

Step 2-26

The revision calculating section 8 notifies the print controlling section 22, and the print controlling section 22 prints a black pattern all over onto a record medium in order to output the degraded toner. At that time, the number of papers to be printed is decided according to the non-operation time (the number of days of non-operation×20).

Step 2-27

When it does not meet the condition in step 2-22 or when the toner is judged that it has not degraded yet in step 2-25 or when the process of step 2-26 ends, the print controlling section 22 judges whether the non-operation time obtained in step 2-3 meets a condition to execute an oligomer adhesion detection test or not. That is to judge whether the non-operation time in a continuous operation state is or has exceeded one week (i.e. the power source on-operation information is "in continuous operation" and the non-operation time is one week or over); or to judge whether the non-operation time after the power source is turned on again is or has exceeded five days (i.e. the power source on-operation information is "power source on-operation" and the non-operation time is five days or over). If it meets, step 2-28 will be performed; and if it does not meet, step 2-32 will be performed.

Step 2-28

The print controlling section 22 prints a test pattern of the oligomer adhesion detection (FIG. 8 or FIG. 9) onto the conveying belt 129 (FIG. 2) through referring to the test pattern storing section 5.

Step 2-29

The density sensor 6 reads the test pattern of the oligomer adhesion detection (FIG. 8 or FIG. 9) which is printed in the step 1-28.

Step 2-30

The revision calculating section 8 judges whether the oligomer is adhering to the photosensitive drum 123 from a density value read out by the density sensor 6. If the oligomer is adhering, step 2-31 is performed; if the oligomer is not adhering, step 2-32 is performed.

Step 2-31

The revision calculating section 8 notifies the print controlling section 22, and the print controlling section 22 controls the photosensitive drum 123 (123K, 123Y, 123M or 123C) (FIG. 2) to rotate in order to remove the oligomer.

Step 2-32

When it does not meet the condition in step 2-27 or when the oligomer does not adhere to in step 2-30 or when the process of step 2-31 ends, the print controlling section 22 judges whether the non-operation time obtained in step 2-3 meets a condition to execute a color deviation correction or not. That is to judge whether the non-operation time in a continuous operation state is or has exceeded one day (i.e. the power source on-operation information is "in continuous operation" and the non-operation time is one day or more); or to judge whether the non-operation time after the power source is turned on again is or has exceeded twelve hours (i.e. the power source on-operation information is "power source on-operation" and the non-operation time is twelve hours or more). If it meets, step 2-33 will be performed; and if it does not meet, step 2-36 will be performed.

Step 2-33

The print controlling section 22 prints a test pattern for the color deviation correction use (FIG. 6 or FIG. 7) onto the conveying belt 129 (FIG. 2) through referring to the test pattern storing section 5.

Step 2-34

The density sensor 6 reads the test pattern for the color deviation correction use (FIG. 6 or FIG. 7) which is printed in the step 1-33.

Step 2-35

The revision calculating section 8 calculates a color deviation correction value and notifies the print controlling section 22, the print controlling section 22 controls the LED head controlling section 4 to update a correction value according to the calculated color deviation correction value.

Step 2-36

When it does not meet the condition in step 2-32 or when the process of step 2-35 ends, the print controlling section 22 judges whether the non-operation time obtained in step 2-3 meets a condition to execute a density correction or not. That is to judge whether the non-operation time in a continuous operation state is or has exceeded three hours (i.e. the power source on-operation information is "in continuous operation" and the non-operation time is three hours or more); or to judge whether the non-operation time after the power source is turned on again is less than twelve hours (i.e. the power source on-operation information is "power source on-operation" and the non-operation time is less than twelve hours). If it meets, step 2-37 will be performed; and if it does not meet, the flow is ended.

Step 2-37

The print controlling section 22 prints a test pattern for the density correction use (FIG. 4) onto the conveying belt 129 (FIG. 2) through referring to the test pattern storing section 5.

Step 1-38

The density sensor 6 reads the test pattern for the density correction use (FIG. 4) which is printed in the step 1-37.

Step 1-39

The revision calculating section 8 calculates a density correction value and notifies the print controlling section 22; the print controlling section 22 controls the developing bias controlling section 2 and the LED head controlling section 4 to update a correction value according to the calculated density correction value, then ends the flow.

Explanation of Effect

As explained above, according to the embodiment, because a condition regarding the on/off operation of a power source is added into the test pattern table, and test execution conditions can be changed on the basis of a presence/absence of the on-operation of the power source, not only it is possible to obtain the effect of the embodiment 1, but also it is possible to execute necessary and substantial test after the power source is turned on again.

Moreover, in the above-stated embodiments, to correspond to respective conditions, that is, to correspond to respective non-operation times, toner degradation detection, oligomer adhesion detection, color deviation adjustment and density correction are separately executed as a detection process (i.e. test process). However, to correspond to one condition, i.e. one non-operation time, a plurality of such processes may be executed.

For example, in the case that once the power source is turned off, after it is turned on again, if the non-operation time is twenty days or over, the toner degradation detection test and the density correction test may be performed. Likewise, if the non-operation time is five days or over, the oligomer adhesion detection test and the density correction test may be performed; if the non-operation time is twelve hours or over, the color deviation adjustment and the density correction test may be performed; and if the non-operation time is less than twelve hours, only the density correction test may be performed.

That is, in such case, the density correction test may be executed to correspond to any non-operation time. Of course, according to necessity, it is possible to select at least two suitable processes to correspond to one condition i.e. one non-operation time.

Therefore, in the present invention, a plurality of processes may be selectively performed to correspond to the length of the non-operation time. On one hand, the longer the non-operation time is, the larger the number of processes selected from the plurality of processes may be; on the other hand, the shorter the non-operation time is, the smaller the number of processes selected from the plurality of processes may be.

Furthermore, in the above stated embodiments, the non-operation time is calculated. The non-operation time is a time from an end of a print process to a start of a next process. The end of a print process is to point a timing at which the drum (i.e. image carrying body) stopped to rotate, or a timing at which the image-fixed paper is ejected.

THE UTILIZATION POSSIBILITY IN INDUSTRY

In the above stated explanation, only such case is explained that the present invention is applied to a printer of electronic photograph. However, the present invention is not limited in the case, the present invention also can be applied to various devices such as scanner, copying apparatus, facsimile apparatus, multifunction apparatus and the like, as an image forming apparatus.

The present invention is not limited to the foregoing embodiments but many modifications and variations are possible within the spirit and scope of the appended claims of the invention.

What is claimed is:

1. An image forming apparatus comprising:

a quality item storing section that stores a plurality of test execution conditions and a plurality of quality items, each of the plurality of test execution conditions corresponding to one of the plurality of quality items, and each of the plurality of test execution conditions corresponding to a length of a non-operation time;

a non-operation time calculating section that calculates the non-operation time after a first print process ends; and a print controlling section that controls an adjustment of a print quality, the print controlling section, according to one of the plurality of test execution conditions that corresponds to a length of the calculated non-operation time, selecting a corresponding one of the plurality of quality items, and adjusting the print quality according to the selected quality item.

2. The image forming apparatus according to claim 1, wherein the quality item storing section stores a plurality of test patterns corresponding to the plurality of quality items in a table.

3. The image forming apparatus according to claim 1, wherein the quality item comprises at least one of a color deviation quantity, a print density, an oligomer adhesion and a toner degradation.

4. The image forming apparatus according to claim 1, wherein the non-operation time is a time from an end of the first print process to a start of a second print process.

5. The image forming apparatus according to claim 1, wherein the non-operation time is a time from when a power source is finally turned off to when the power source is turned on again.

6. The image forming apparatus according to claim 1, wherein a plurality of processes related to a second print process are selectively performed corresponding to the length of the calculated non-operation time.

7. The image forming apparatus according to claim 6, wherein the longer the calculated non-operation time is, the larger the number of processes selected from the plurality of processes is.

8. The image forming apparatus according to claim 7, wherein the shorter the calculated non-operation time is, the smaller the number of processes selected from the plurality of processes is.

9. The image forming apparatus according to claim 6, wherein the shorter the calculated non-operation time is, the smaller the number of processes selected from the plurality of processes is.

10. The image forming apparatus according to claim 1, wherein the plurality of test execution conditions includes a first test execution condition corresponding to a first length of the non-operation time when the image forming apparatus is always on, and a second test execution condition corresponding to a second length of the non-operation time when the image forming apparatus is turned off and then turned on again; and the second length is smaller than the first length.

* * * * *